US008540346B2

(12) United States Patent
Dolan et al.

(10) Patent No.: US 8,540,346 B2
(45) Date of Patent: Sep. 24, 2013

(54) PATTERNED METALLIZATION ON POLYIMIDE APERTURE PLATE FOR LASER-ABLATED NOZZEL

(75) Inventors: Bryan R. Dolan, Webster, NY (US); Peter M. Gulvin, Webster, NY (US); Hong Zhao, Webster, NY (US); John R. Andrews, Fairport, NY (US); Bradley J. Gerner, Penfield, NY (US); Antonio Williams, Rochester, NY (US); Kock-Yee Law, Penfield, NY (US); David P. Platt, Newberg, OR (US); Terrance L. Stephens, Molalla, OR (US)

(73) Assignee: Xerox Corporation, Norwalk, CT (US)

( * ) Notice: Subject to any disclaimer, the term of this patent is extended or adjusted under 35 U.S.C. 154(b) by 88 days.

(21) Appl. No.: 13/095,610

(22) Filed: Apr. 27, 2011

(65) Prior Publication Data

US 2012/0274706 A1 Nov. 1, 2012

(51) Int. Cl.
*B41J 2/14* (2006.01)
*B41J 2/16* (2006.01)

(52) U.S. Cl.
USPC ..... 347/47

(58) Field of Classification Search
USPC ..... 347/47
See application file for complete search history.

(56) References Cited

U.S. PATENT DOCUMENTS 7,568,785 B2 * 8/2009 Deguchi et al. ..... 347/48
2007/0040866 A1 * 2/2007 Funatsu et al. ..... 347/47

OTHER PUBLICATIONS

Dolan et al., "Polyer Layer Removal on PZT Arrays Using a Plasma Etch", U.S. Appl. No. 13/011,409, filed Jan. 21, 2011.
"Metalized Polyimide Aperture Plate and Method for Preparing Same", U.S. Appl. No. 12/905,561, filed Oct. 15, 2010.

* cited by examiner

*Primary Examiner* — Matthew Luu
*Assistant Examiner* — Renee I Wilson
(74) *Attorney, Agent, or Firm* — MH2 Technology Law Group LLP

(57) ABSTRACT

An aperture plate for a print head of a printer can include a first layer having a first emissivity which is covered by a second layer having a second emissivity which is less than the first emissivity. In an embodiment, the second layer can be etched at nozzle locations to form openings in the second layer which have widths/areas greater than widths/areas of nozzles formed in the first layer. In another embodiment, the second layer can have a smaller thickness at the nozzle locations and a larger thickness away from the nozzle locations. Forming the openings in the second layer which are larger than the nozzles, or forming the second layer thinner at the nozzle locations prior to forming the nozzles, can provide a well-formed nozzle and an aperture plate having a low emissivity.

7 Claims, 9 Drawing Sheets

PATTERNED METALLIZATION ON POLYIMIDE APERTURE PLATE FOR LASER-ABLATED NOZZEL

FIELD OF THE EMBODIMENTS

The present teachings relate to the field of ink jet printing devices and, more particularly, to an ink jet print head and methods of making an ink jet print head.

BACKGROUND OF THE EMBODIMENTS

Fluid ink jet systems typically include one or more print heads having a plurality of ink jets from which drops of fluid are ejected toward a recording medium. The ink jets of a print head receive ink from an ink supply chamber (manifold) in the print head which, in turn, receives ink from a source such as an ink reservoir or an ink cartridge. Each ink jet includes a channel having one end in fluid communication with the ink supply manifold. The other end of the ink channel has an orifice or nozzle for ejecting drops of ink. The nozzles of the ink jets may be formed in an aperture plate that has openings corresponding to the nozzles of the ink jets. During operation, drop ejecting signals activate actuators to expel drops of fluid from the ink jet nozzles onto the recording medium. By selectively activating the actuators to eject ink drops as the recording medium and/or print head assembly are moved relative to one another, the deposited drops can be precisely patterned to form particular text and/or graphic images on the recording medium.

Ink jet print heads have been constructed using stainless steel aperture plates with nozzles which are etched chemically or formed mechanically. Reducing cost and improving the performance of ink jet print heads is an ongoing goal of design engineers. A print head having improved performance and lower cost than conventional print heads would be desirable.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

In an embodiment of the present teachings, a method for forming a print head aperture plate can include covering a first layer having a first emissivity with a second layer having a second emissivity, wherein the first emissivity is higher than the second emissivity, patterning the second layer by removing at least a portion of the second layer from a nozzle location and leaving at least a portion of the first layer at the nozzle location and, after patterning the second layer, forming at least one nozzle through the first layer.

In another embodiment of the present teachings, a print head aperture plate can include a first layer having a first emissivity, a second layer over the first layer, the second layer having a second emissivity which is lower than the first emissivity, and at least one nozzle extending through the first layer, wherein the at least one nozzle has an edge and a first thickness of the second layer exposed at the at least one nozzle edge is less than a second thickness of the second layer at a location remote from the nozzle edge.

In another embodiment of the present teachings, a printer can include a print head aperture plate, comprising a first layer having a first emissivity, a second layer over the first layer, the second layer having a second emissivity which is lower than the first emissivity, at least one nozzle extending through the first layer, wherein the at least one nozzle has an edge, wherein a first thickness of the second layer exposed at the at least one nozzle edge is less than a second thickness of the second layer at a location remote from the nozzle edge. The printer can further include a jet stack subassembly comprising a plurality of piezoelectric elements, wherein the print head aperture plate is attached to the jet stack subassembly, a printed circuit board comprising a plurality of electrodes, wherein each of the plurality of electrodes is electrically coupled to one of the piezoelectric elements, a manifold attached to the printed circuit board, and an ink reservoir formed by a surface of the manifold and a surface of the printed circuit board.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

Figure 1:
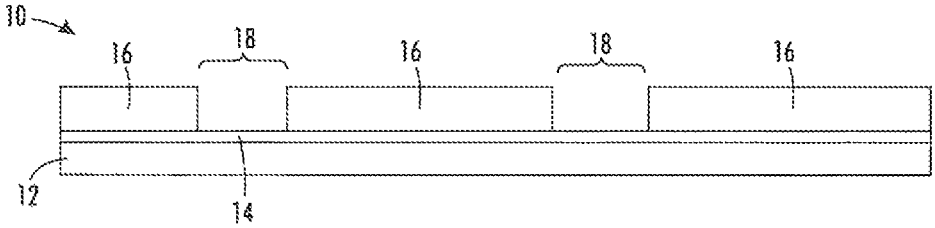
FIGS. 1-5 are cross sections.

It should be noted that some details of the FIGS. have been simplified and are drawn to facilitate understanding of the present teachings rather than to maintain strict structural accuracy, detail, and scale.

DESCRIPTION OF THE EMBODIMENTS

Reference will now be made in detail to the present exemplary embodiments of the present teachings, examples of which are illustrated in the accompanying drawings. Wherever possible, the same reference numbers will be used throughout the drawings to refer to the same or like parts.

As used herein, the word "printer" encompasses any apparatus that performs a print outputting function for any purpose, such as a digital copier, bookmaking machine, facsimile machine, a multi-function machine, etc. The word "polymer" encompasses any one of a broad range of carbon-based compounds formed from long-chain molecules including thermoset polyimides, thermoplastics, resins, polycarbonates, and related compounds known to the art.

Stainless steel aperture plates are suitable for their intended purpose, but are expensive to manufacture due to the formation of apertures or nozzles using chemical or mechanical techniques. A polyimide aperture plate is less expensive to manufacture, for example because the nozzles can be laser etched, which reduces processing time and costs. However, polyimide has a much higher emissivity (0.95) than stainless steel (0.4), so radiative heat losses can be 137% higher with polyimide than stainless steel. For purposes of the present disclosure, "emissivity" is the relative ability of a material's surface to emit energy by radiation. An ink jet aperture plate with a low emissivity is generally more desirable, for example because a printing device with low emissive aperture plate uses less power than a printing device with an aperture plate having a higher emissivity.

An ink jet print head, a printer including the ink jet print head, and methods of forming the ink jet print head using a polyimide aperture plate is described in U.S. patent Ser. No. 12/905,561, titled "Metalized Polyimide Aperture Plate and Method for Preparing Same," filed Oct. 15, 2010, which is incorporated herein by reference in its entirety. The ink jet print head of the aforementioned application can include an aperture plate with a first layer (for example, polyimide) having an emissivity and a second layer (for example, aluminum) having an emissivity, wherein the emissivity of the first layer is higher than the emissivity of the second layer. The emissivity of the described aperture plate (for example, polyimide and aluminum) is less than the emissivity of a polyimide aperture plate which omits the aluminum second layer, because the aluminum layer decreases the overall emissivity of the aperture plate. Furthermore, a low energy coating can be applied to the aluminum layer so that ink is more easily removed from the exterior of the aperture plate, for example through self-cleaning or removal using a wiper blade. A low energy coating adheres poorly to polyimide.

An embodiment of the present teachings is described with reference to FIGS. 1-6. FIG. 1 depicts an in-process aperture plate assembly 10 including a first layer 12 having a first emissivity and a second layer 14 having a second emissivity, wherein the first emissivity is higher than the second emissivity. In an embodiment, the first layer can include polyimide and the second layer which covers the first layer can include aluminum. In another embodiment, the first layer can be polyimide, polycarbonate, polyester, polyetherketone, polyetherimide, polyethersulfone, polysulfone, liquid crystal polymer, and other polymers or combinations thereof, and the second layer can be aluminum, nickel, gold, silver, copper, chromium, titanium, a metal alloy, and other metals or combinations thereof.

Polyimide has good strength, good workability, and reasonable cost, and vacuum-deposited aluminum has a low emissivity value. For simplicity of explanation, the disclosure below is described with reference to a first layer of polyimide and a second layer of aluminum, but it will be realized that the first layer can include one or more other polymer and the second layer can include one or more other metal.

In an embodiment, the polyimide 12 can be any suitable thickness, for example between about 8 microns and about 75 microns, or between about 13 microns and about 50 microns, or between about 25 microns to about 38 microns thick. In a specific embodiment, the first layer 12 is about 25 microns thick. In an embodiment, the first layer can be a 1 mil thick DuPont™ Kapton® HN polyimide film.

In an embodiment, the second layer 14 can be any suitable thickness, for example between about 50 angstroms (Å) and about 1.0 micron, or between about 200 Å and about 5000 Å, or between about 300 Å and about 1000 Å thick. In embodiments, the second layer can be a sub-micron aluminum layer. In an embodiment, the second layer can be a 1.0 micron thick aluminum layer. The aluminum layer can be formed on the polyimide layer using any suitable process, for example physical vapor deposition (PVD), chemical vapor deposition (CVD), atomic layer deposition (ALD), sputtering, lamination, etc.

FIG. 1 further depicts a patterned mask 16 having openings 18 therein which expose the aluminum 14. The patterned mask 16 can be a photosensitive layer such as photoresist which is patterned using conventional optical photolithography. The patterned mask can also be formed by spraying, stamping, spin coating, and can be a shadow mask or a dry film photoresist. The openings can be any desired shape, for example round, square, rectangular, oval, star-shaped, etc., and can overlap adjacent openings, for example as overlapping circles. In this embodiment, however, an area or width (or, in the case of a circular opening, a diameter) of each opening will be larger or wider than an area or width of a nozzle aperture (nozzle) which will subsequently be formed in the polyimide 12. Additionally, an area or width of each opening can be larger or wider than a cross sectional area or width of a laser beam which is used to form nozzles during subsequent processing. Further, the area or width of the opening can be oversized to allow for alignment tolerance. Each opening 18 can be targeted to be centered on a location where the nozzle will subsequently be formed. In an embodiment, the openings 18 can be circular and have a diameter of between about 50 microns and about 700 microns, or between about 100 microns and about 400 microns, or between about 200 microns and about 300 microns. In terms of area, the openings 18 can be circular and have an area of between about 150 microns$^2$ and about 2200 microns$^2$, or between about 315 microns$^2$ and about 1250 microns$^2$, or between about 630 microns$^2$ and about 350 microns$^2$.

Figure 2:
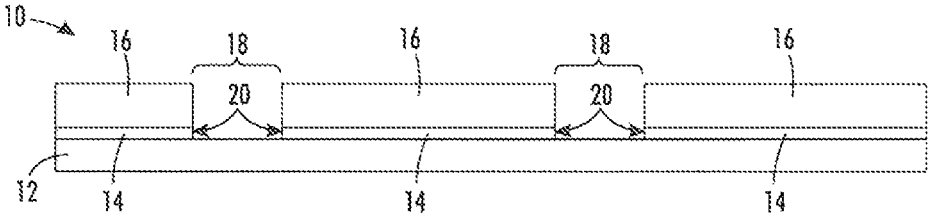

Next, as depicted in FIG. 2, the aluminum is etched selective to the polyimide to remove the exposed aluminum 14 and to pattern the aluminum 14, which forms openings in the aluminum 14. Etching the aluminum 14 forms edges 20 of the aluminum 14. A wet etch, a dry etch, or both, can be performed to remove the aluminum layer. For example, an aluminum layer which is 1.0 micron thick can be removed by plasma etching for a duration of less than one minute. To improve tolerances to alignment, each opening in the metal can have an ellipsis shape, wherein the long axis of the ellipse is oriented either parallel or perpendicular to the long axis of the aperture plate. The orientation to the aperture plate will depend on various factors related to mechanical alignment and stretching or shrinking of the polyimide during processing. Additionally, other patterning features can be stamped, etched (for example using a pattern in mask 16), or printed into the metal 14 to serve other functions. For example, identification codes, manufacturing codes, serial numbers, or other indicia, or alignment targets to aid the placement of the openings within the metal or nozzle placement during subsequent processing, can be stamped, etched, or printed into metal 14.

Figure 3:
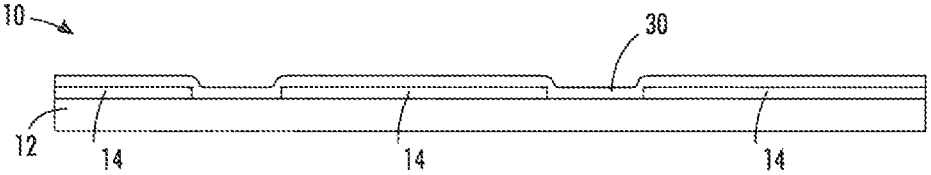

After forming a structure similar to that depicted in FIG. 2, the patterned mask 16 is removed and an optional low energy coating 30 is applied to the aluminum 14 as depicted in FIG. 3. In this embodiment, the coating 30 encapsulates the exposed etched edges 20 of the aluminum, and also physically contacts the polyimide 12. The coating can provide an anti-wetting agent for the completed aperture plate during use, and can improve jetting performance and assist in the removal of ink and other contaminants during print head maintenance. The coating can be applied as a liquid solution, such as Solvay Solexis Fluorolink® perfluoropolyether (PFPE), and then cured to remove volatile solvents to result in a solid coating. In another embodiment, the coating can be a vapor-phase deposited material such as a fluorinated diamond-like carbon (f-DLC) or a perfluoroalkoxy copolymer resin such as DuPont™ Teflon®. Other materials suitable for the coating include a fluoropolymer, a siloxane polymer, and polytetrafluoroethylene.

In embodiments, the coating 30 can have a thickness of between about 400 Å to about 2,000 Å, or from about 650 Å to about 1,350 Å, or from about 900 to about 1,150 Å thick.

In embodiments, the coating 30 can provide contact angle characteristics such that satellite droplets of UV gel ink and solid ink, for example 3 microliter drops of UV ink and 1 microliter drops of solid ink, landing on the aperture plate exhibit a contact angle of from about 35° to about 120°, in specific embodiments a contact angle greater than about 35° or greater than about 55° with coating 30.

Figure 4:
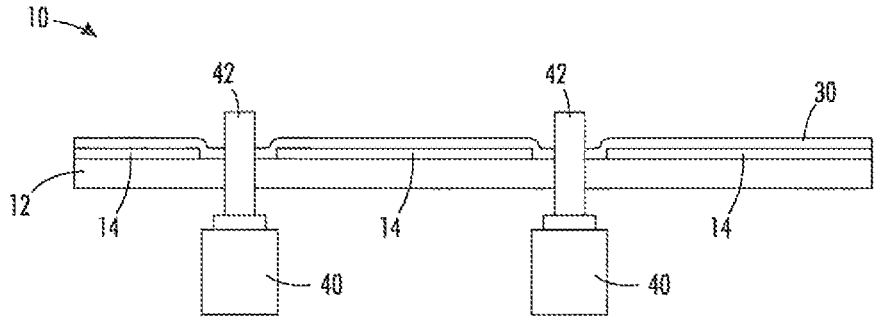
Figure 5:
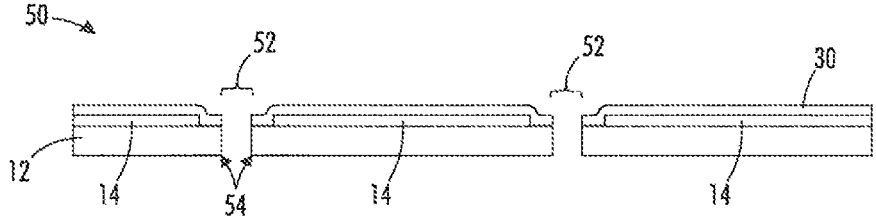

After forming a structure similar to that depicted in FIG. 3, nozzles can be formed through the polyimide 12 and, if present, the optional coating 30. In an embodiment, the nozzles can be formed using one or more lasers 40 as depicted in FIG. 4, for example one or more excimer lasers, each outputting a laser beam 42. FIG. 5 depicts a completed aperture plate 50, wherein laser ablation of the polyimide 12 and the coating 30 in FIG. 4 forms nozzles 52 as depicted in FIG. 5.

The nozzles 52 can be circular and have a width (or, in the case of a circular opening, a diameter) of between about 25 microns and about 100 microns, or between about 30 microns and about 75 microns, or between about 35 microns or about 45 microns. In terms of area, the nozzles can be circular and have an area of between about 75 microns$^2$ and about 315 microns$^2$, or between about 90 microns$^2$ and about 235 microns$^2$, or between about 110 microns$^2$ or about 140 microns$^2$. Nozzles 52 can be smaller than, and targeted to be concentric with, the openings in the aluminum layer 14. Additionally, the nozzles can have shapes other than circular, such as square, rectangular, oval, and star shaped.

If the aluminum 14 was not patterned according to this embodiment, the formation of the nozzles 52 with a laser beam 42 at FIG. 4 would rely on vaporization of the aluminum 14 by the laser beam 42 to provide a well-formed nozzle 52. However, it has been found that in some instances the laser beam 42 does not sufficiently vaporize the aluminum 14, but rather melts the aluminum 14. As a result, the liquid aluminum 14 flows along the surface of the polyimide 12 due to surface tension. The liquid aluminum can then coalesce to form residual metal "flaps" around the perimeter of the nozzle 52. These flaps can affect the roundness of the nozzle, can interfere with the flow of ink through the nozzle 52, and may adversely affect the shape and trajectory of the projected ink during printing. With this embodiment, however, the laser beam 42 does not overlap the aluminum 14 during the formation of the nozzles 52 as depicted in FIG. 4. The thermal energy transferred to the aluminum 14 through the polyimide 12 and coating 30 during the formation of the nozzles is likely insufficient to melt the aluminum 14. Even if the aluminum 14 is melted due to the conduction of heat through the polyimide 12 or the coating 30, the aluminum 14 is encapsulated between the coating 30 and the polyimide 12. In embodiments where the coating 30 is omitted, the aluminum is not encapsulated; however, a distance between the edge 20 of the aluminum 14 and the edge 54 of the nozzle 52 can be targeted according to the thickness of the aluminum to prevent any melted aluminum from flowing to the edge of the nozzle, or to ensure energy transfer from the laser beam 42 is insufficient to melt the aluminum 14.

Additionally, covering the edge of the aluminum 14 with coating 30 to encapsulate the aluminum 14 prevents contact between the ink within the nozzle and the aluminum 14 during use. Thus any adverse chemical reaction between the ink and the metal 14 is prevented. Further, exposed aluminum at the nozzle edge is eliminated, which may decrease layer delamination at the nozzle edge.

Figure 6:
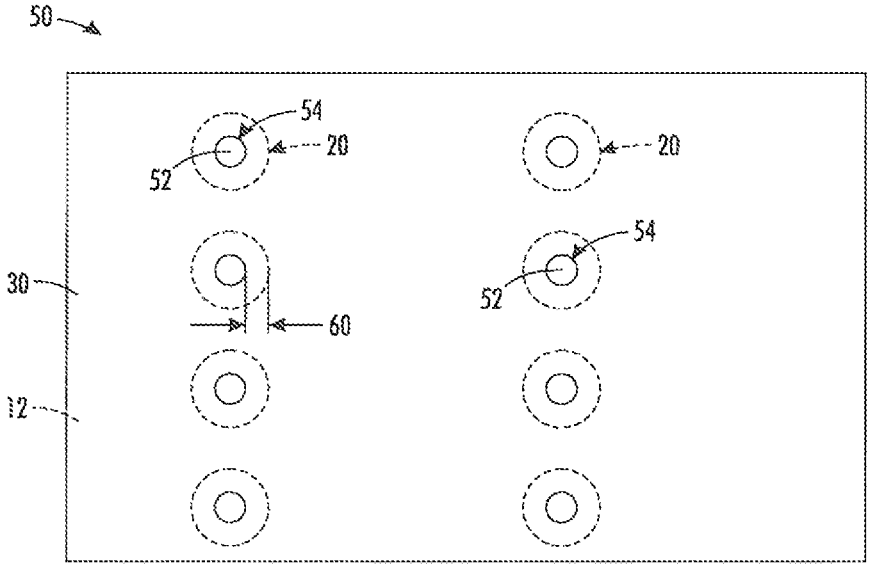
FIG. 6 is a plan view, depicting an in-process aperture plate in accordance with an embodiment of the present teachings.

FIG. 6 is a plan view of the FIG. 5 structure depicting an array of nozzles 52 on a portion of an aperture plate 50. A distance 60 between an edge 20 of the aluminum 14 and an edge 54 of the nozzle 52 can be targeted to prevent the formation of metal flaps at the edge 54 of the nozzle 52. While FIG. 6 depicts an exemplary 4×2 array of nozzles, it will be understood that aperture plate can include a larger array of nozzles, for example a 344×20 array.

As depicted in FIGS. 5 and 6, a first thickness of the aluminum 14 at the edge 54 of the nozzle is zero, and a second thickness of the aluminum 14 at a location remote from the edge 54 of the nozzle 52 is greater than zero. As depicted in FIG. 6, the openings 20 in the aluminum 14 are circular, the nozzles 52 are circular, and each opening 20 in the aluminum 14 encircles a nozzle 52. In an embodiment, the circular nozzle 52 and the circular opening 20 in the aluminum 14 can be targeted to be concentric.

Figure 7:
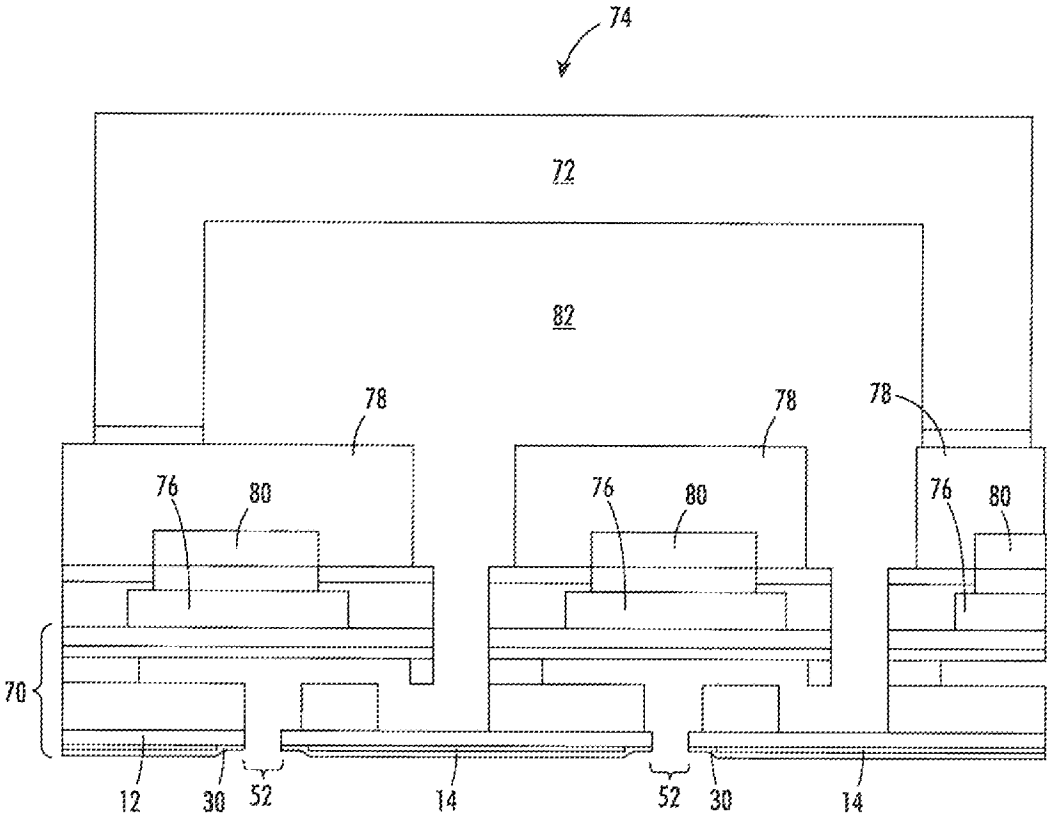
FIG. 7 is a cross section depicting a print head in accordance with an embodiment of the present teachings.

After forming the aperture plate 50, it can be attached to a jet stack subassembly to form a jet stack 70 as depicted in FIG. 7. The jet stack can then be attached to a manifold 72 to form a print head 74. The print head 74 can include various structures, including piezoelectric elements 76, a printed circuit board 78, electrodes 80, and an ink reservoir 82 formed by a surface of the manifold and a surface of the printed circuit board. The formation and use of a print head is discussed in U.S. patent Ser. No. 13/011,409, titled "Polymer Layer Removal on PZT Arrays Using A Plasma Etch," filed Jan. 21, 2011, which is incorporated herein by reference in its entirety.

The methods and structure described above thereby form an aperture plate 50 for an ink jet printer. In an embodiment, the aperture plate 50 can be used as part of an ink jet print head 74 as depicted in FIG. 7.

Figure 8:
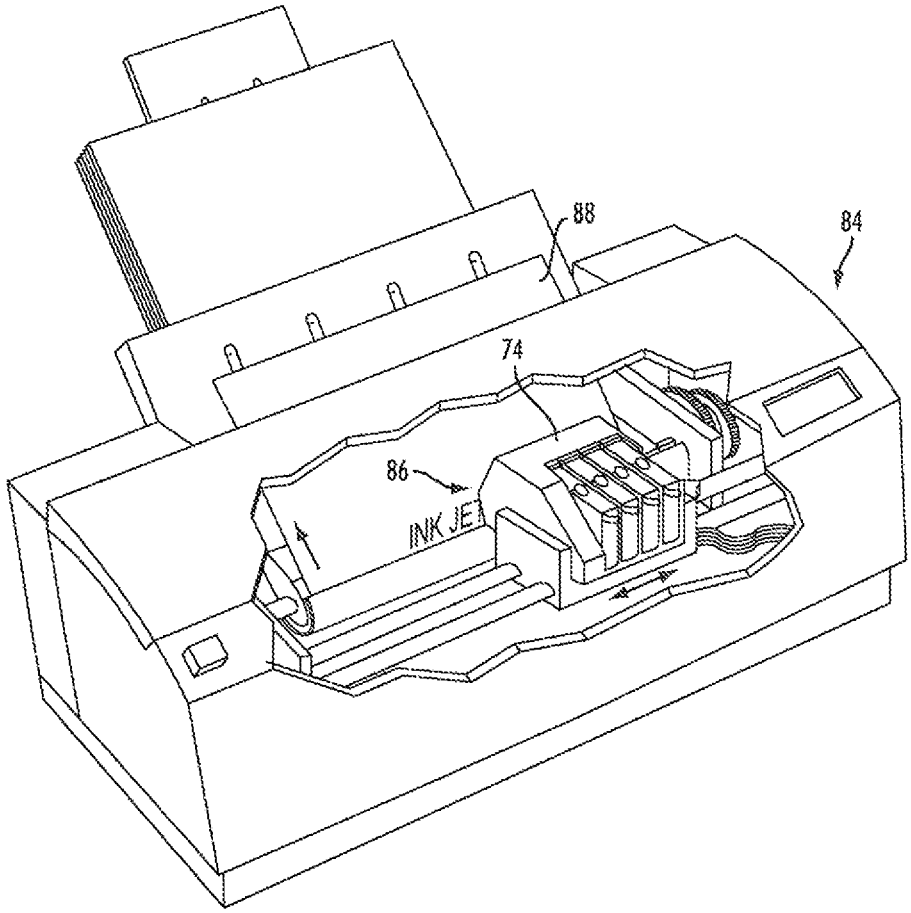
FIG. 8 is a representation of a printing device formed in accordance with an embodiment of the present teachings.

FIG. 8 depicts a printer 84 including one or more print heads 74 and ink 86 being ejected from one or more nozzles 52 (FIG. 5) in accordance with an embodiment of the present teachings. The print head 74 is operated in accordance with digital instructions to create a desired image on a print medium 88 such as a paper sheet, plastic, etc. The print head 74 may move back and forth relative to the print medium 88 in a scanning motion to generate the printed image swath by swath. Alternately, the print head 74 may be held fixed and the print medium 88 moved relative to the print head, creating an image as wide as the print head 74 in a single pass. The print head 74 can be narrower than, or as wide as, the print medium 88.

Adding a metal second layer to the first layer significantly reduces heat losses and radiative power loss, thereby decreasing power usage compared to printers using polyimide aperture plates. In the case of aluminum, the emissivity is expected to be less than 0.1, reducing radiative power losses by 75% compared to standard stainless steel and by 90% compared to raw polyimide. Furthermore, patterning the metal to provide an opening larger than the nozzles prior to forming the nozzles reduces or eliminates problems resulting from melted metal. While patterning the metal away from the location of the nozzle exposes the polyimide and may result in a slight increase in emissivity due to less metal surface area, the increase is expected to be less than 5%, and may be less than 2%. In general, an increase in emissivity may occur with increasing nozzle density.

Figure 9:
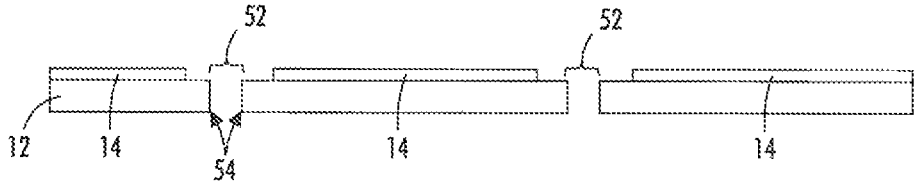
FIGS. 9 and 10 are cross sections depicting an in-process aperture plate according to another embodiment of the present teachings.
Figure 10:
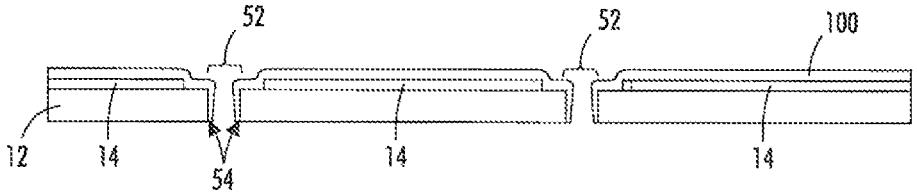

Various alternate embodiments are contemplated. For example, in another embodiment, the FIG. 2 structure can be formed, then the patterned mask 16 can be removed. Subsequently, laser formation of the nozzles 52 in the polyimide layer 12 as depicted in FIG. 9 can be performed. In an embodiment, the FIG. 9 structure forms a completed aperture plate. In another embodiment, a patterned coating 100 can be formed as depicted in FIG. 10 using, for example, a plasma or electron beam process to deposit an anti-wetting layer such as a copolymer of Teflon and perfluoroalkoxyvinal ether (i.e., PFA Teflon) or fluorinated diamond-like carbon films (FDLC).

Figure 11:
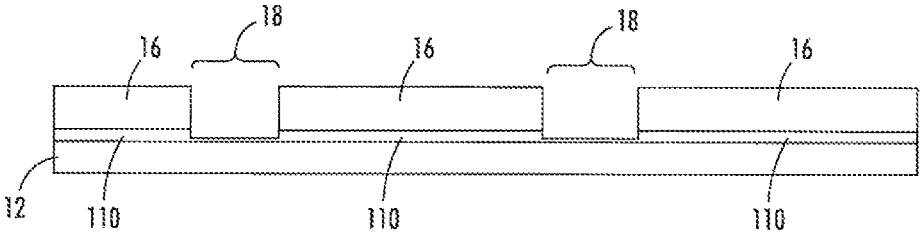
FIGS. 11 and 12 are cross sections depicting an in-process aperture plate according to another embodiment of the present teachings.
Figure 12:
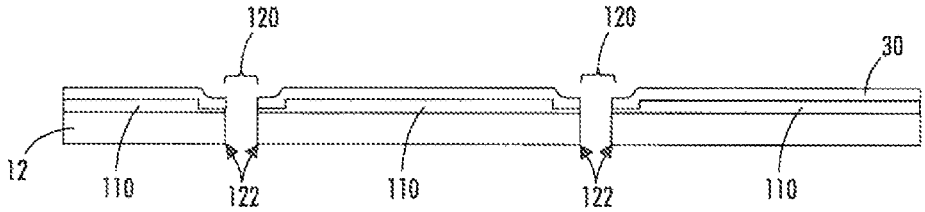

FIGS. 11 and 12 depict another embodiment of the present teachings. This embodiment can start with a structure similar to that depicted in FIG. 2, then the aluminum 14 is only partially etched to thin, but not completely etch through, the aluminum to result in the thinned aluminum 110 of FIG. 11. The partial etch of the aluminum 110 can be performed using a timed etch sufficient to only partially etch through the aluminum 110. The etch duration will depend on the composition and starting thickness of the layer 110, the width of opening 18, and the type of etch and etchant. Thus the polyimide 12 is not exposed during the etch of the aluminum 110. The process can then continue according to the embodiment of FIGS. 3-5 to result in the FIG. 12 structure which includes coating 30.

In this embodiment, the aluminum 110 can be thinned from a starting thickness of between about 500 Å and about 5000 Å, to an ending thickness of between about 100 Å and about 300 Å. While the thickness of the aluminum 110 isn't completely removed, thinning the aluminum 110 can result in improved laser ablation so that the thinned portion of the aluminum 110 does not coalesce around the perimeter of the nozzle 52 upon melting. Additionally, only partially etching through the aluminum will result in metal up to the edge 122 of each nozzle 120 as depicted in FIG. 12. Thus the total surface area of the metal 110 is not decreased, which may result in improved emissivity of the completed structure over the embodiment of FIG. 5. This embodiment may be advantageous particularly in structures having a very high density of nozzles, which would have a higher percentage of metal removed than structures having a low nozzle density.

As depicted in FIG. 12, a first thickness of the aluminum 110 at the edge 122 of the nozzle 120 is less than a second thickness of the aluminum 110 at a location remote from the edge 122 of the nozzle 120. In an embodiment, a thickness of the aluminum 110 exposed at the edge 122 of the nozzle 120 can be between about 100 Å and about 300 Å, and a thickness of the aluminum 110 at the location remote from the edge 122 of the nozzle 120 can be between about 500 Å and about 5000 Å.

Figure 13:
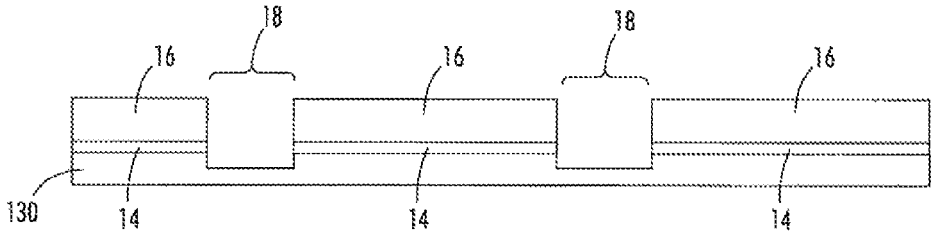
FIGS. 13 and 14 are cross sections depicting an in-process aperture plate according to another embodiment of the present teachings.
Figure 14:
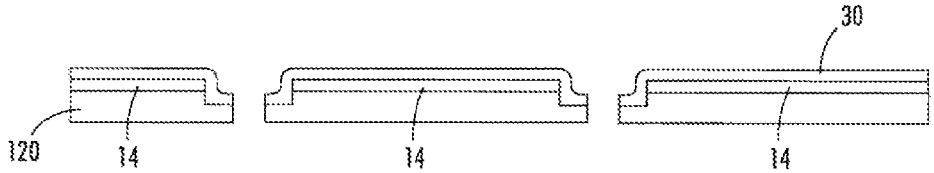

FIGS. 13 and 14 depict another embodiment of the present teachings. This embodiment can start with a structure similar to that depicted in FIG. 2, then an etch of the structure is performed to etch through the complete thickness of the aluminum 14, and to etch into the thickness of the polyimide 12 to result in the polyimide 130 of FIG. 13. The aluminum 14 and polyimide 12 can be etched using techniques known in the art. The process can then continue according to the embodiment of FIGS. 3-5 to form the FIG. 14 structure.

In this embodiment, the polyimide 130 can be thinned from a FIG. 2 starting thickness of between about 25 microns and about 38 microns, to a FIG. 13 an ending thickness in the location of the nozzle of between about 10 microns and about 25 microns. The polyimide 130 can have a thickness suitable for support, while thinning the polyimide in the nozzle location decreases the amount of polyimide which must be laser ablated, and may therefore simplify nozzle formation.

Figure 15:
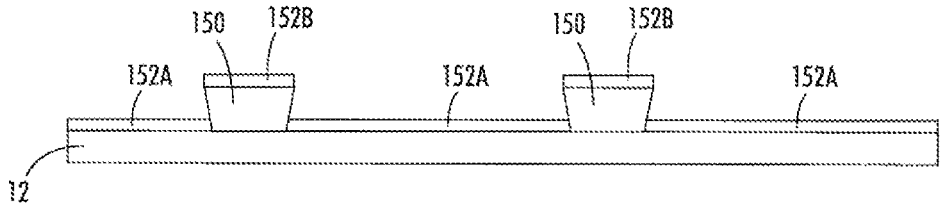
FIGS. 15 and 16 are cross sections depicting an in-process aperture plate according to another embodiment of the present teachings.
Figure 16:
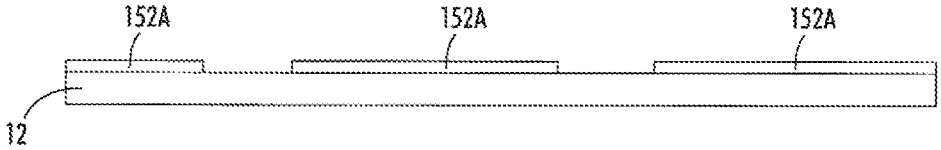
Figure 17:
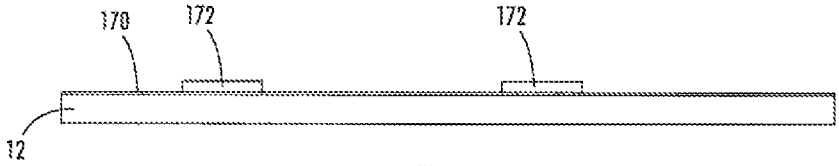
FIGS. 17-21 are cross sections depicting another embodiment of the present teachings.

In an alternate method, a metal lift-off process can be used to form the second layer. As depicted in FIG. 15, a patterned mask 150 such as a patterned photoresist layer is formed on the polyimide 12 over future nozzle locations. The patterned mask 150 can be formed larger than the nozzle to leave additional distance such as distance 60 (FIG. 6) between the edge of the nozzle and the edge of the metal. Additionally, the patterned mask 150 can be formed with a retrograde profile such that the directional (vertical) deposit of metal results in little or no metal material on mask sidewalls. After forming patterned mask 150, a directional metal deposition is performed, such as by sputtering. This forms metal 152A on the exposed polyimide 12 and metal 152B on the top of the patterned mask 150. A short optional metal etch can be used to clear any metal which forms on the vertically oriented sidewall of mask 150 which, if it forms at all, will form with a thickness which is less than the material on horizontally oriented surfaces. Subsequently, the patterned mask is etched away which leaves metal 152A and frees metal 152B, so metal 152B can be removed as depicted in FIG. 16. Processing can be continued according to FIGS. 3-5, for example, to form a completed aperture plate. In another embodiment, the material which forms patterned layer 150 can be something other than photoresist, such as perfluoropolyether or other oil, which can be patterned using, for example, screen printing or flexography (flexo) printing. It will be understood that other materials may be thinner than the photoresist 150 depicted in FIG. 15, and may have any of a prograde, vertical, or retrograde profile.

FIGS. 17-21 depict another embodiment of the present teachings. This embodiment can result in a structure similar to that depicted in FIG. 12, but does not rely on a timed etch. This embodiment can provide improved process control and does not rely on a timed etch.

Figure 18:
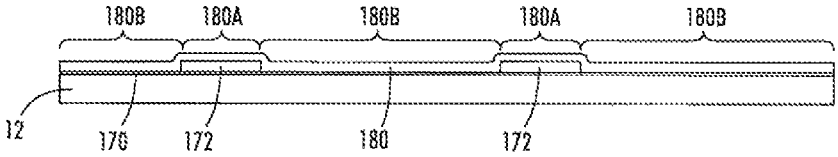
Figure 19:
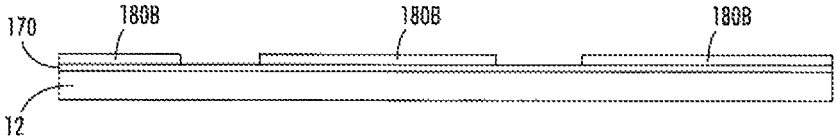

In this embodiment, a blanket first aluminum layer 170, for example having a thickness of between about 100 Å and about 300 Å is formed over a polyimide layer 12. Next, a patterned removable layer 172 is formed. The patterned removable layer 172 can include one or more materials such as a fluoropolymer, photoresist, etc. The patterned removable layer can be formed as a blanket layer and patterned using photolithography, or can be patterned using a screen printing process, for example. After forming the FIG. 17 structure, a blanket conformal second aluminum layer 180 is formed over the first aluminum layer 170 and over the patterned removable layer as depicted in FIG. 18. At least a first portion 180A of the second aluminum layer 180 overlies and physically contacts the patterned removable layer 172, while at least a second portion 180B of the second aluminum layer 180 overlies and physically contacts the first aluminum layer 170, but does not overlie the patterned removable layer 172. Next, the first portion 180A of the second aluminum layer 180 is removed along with the patterned removable layer 172 as depicted in FIG. 19. The second portion 180B of the second aluminum layer 180 adheres to the first aluminum layer 170, and is not removed.

Figure 20:
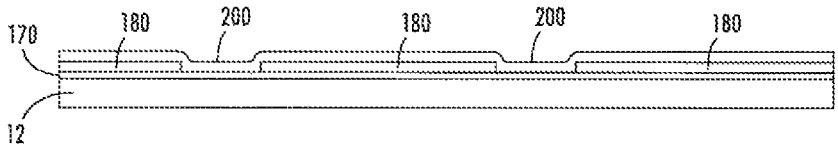

Next, an optional low energy coating 200 can be applied to the upper surface of the FIG. 19 structure as depicted in FIG. 20. This coating can be similar to coating 30 as described above.

Figure 21:
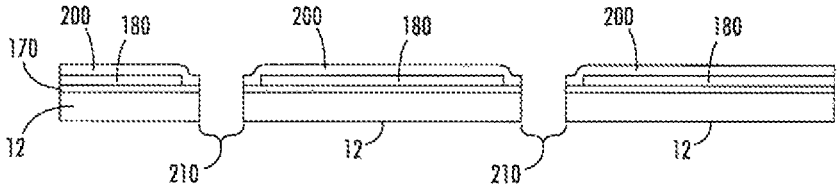

Subsequently, at least one nozzle 210, for example a plurality of nozzles 210, can be formed through the polyimide 12, the first aluminum layer 170, and the optional coating 200 as depicted in FIG. 21. The nozzles 210 can be formed according the to techniques described above.

In this embodiment, the thickness of layer 170 does not rely on a timed etch, but instead is formed as blanket layer to a suitable thickness The addition of layer 180 results in a thicker total aluminum including both the first aluminum layer 170 and the second aluminum layer 180 away from the nozzle 210, but only layer 170 at the nozzle 210. This embodiment leaves metal 170 up to the edge of the nozzle, such that the emissivity remains low due to the entire surface of the polyimide 12 being covered by aluminum.

Thus the methods above can be used to form an aperture plate, a print head, and a printing device. The aperture plate can have a decreased emissivity and decreased radiative power loss over a solid polyimide aperture plate, due to the formation of an overlying metal layer. Further, a low-energy coating will adhere better to the metal layer than to a polyimide surface, thereby improving the removal of ink during print head maintenance or self-cleaning. A low-energy coating can reduce ink drooling. Additionally, the metal according to some of the embodiments described above will not be exposed to ink during use, which can reduce or eliminate chemical interaction between the ink and the metal. Also, removing the metal from around the location of the nozzle prior to nozzle formation can eliminate metal flaps which may otherwise form around the edge of the nozzle due to melting of the metal during nozzle formation. In some embodiments, the metal is only partially etched to thin, but not remove, the metal in the area of the nozzle, which results in a complete metal surface so that emissivity is not increased, which can occur if metal is completely removed from an area which is larger than the nozzle opening.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. In addition, while a particular feature of the disclosure may have been described with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a wafer or substrate, regardless of the orientation of the wafer or substrate. The term "horizontal" or "lateral" as used in this application is defined as a plane parallel to the conventional plane or working surface of a wafer or substrate, regardless of the orientation of the wafer or substrate. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the wafer or substrate, regardless of the orientation of the wafer or substrate.

The invention claimed is:

1. A print head aperture plate, comprising:

a first layer having a first emissivity and comprising at least one opening therein defined by an edge of the first layer;

a second layer over the first layer, the second layer having a second emissivity which is lower than the first emissivity and comprising at least one opening therein defined by an edge of the second layer, wherein the edge of the second layer is targeted to be vertically aligned with the edge of the first layer; and at least one nozzle extending through the first layer and through the second layer, wherein the at least one nozzle has an edge formed by the edge of the opening in the first layer and the edge of the opening in the second layer, and a first thickness of the second layer exposed at the at least one nozzle edge is less than a second thickness of the second layer at a location remote from the nozzle edge.

2. The print head aperture plate of claim 1, wherein the first thickness of the second layer exposed at the at least one nozzle edge is between about 100 Å and about 300 Å, and the second thickness of the second layer at the location remote from the nozzle edge is between about 500 Å and about 5000 Å.

3. The print head aperture plate of claim 1, wherein the first thickness of the second layer exposed at the at least one nozzle edge is zero, and the second thickness of the second layer at the location remote from the nozzle edge is greater than zero.

4. The print head aperture plate of claim 3, wherein:

the opening in the first layer is a circular opening;

the opening in the second layer is a circular opening and is targeted to be the same size as the opening in the first layer; and the at least one nozzle is circular.

5. The print head aperture plate of claim 4 wherein the at least one nozzle and the at least one circular opening through the second layer are targeted to be concentric.

6. The print head aperture plate of claim 1, wherein:

the first layer comprises a polyimide; and the second layer comprises aluminum.

7. The print head aperture plate of claim 1, wherein:

the print head aperture plate comprises an inside surface from which ink is supplied and an outside surface from which ink is ejected; and the second layer is closer to the outside surface of the print head aperture plate than the first layer.

* * * * *

UNITED STATES PATENT AND TRADEMARK OFFICE

CERTIFICATE OF CORRECTION

PATENT NO. : 8,540,346 B2
APPLICATION NO. : 13/095610
DATED : September 24, 2013
INVENTOR(S) : Bryan R. Dolan et al.

It is certified that error appears in the above-identified patent and that said Letters Patent is hereby corrected as shown below:

On the Title page, item (54) and in the Specification, Col. 1, the title reads "PATTERNED METALLIZATION ON POLIMIDE APERTURE PLATE FOR LASER-ABLATED NOZZEL" should read -- PATTERNED METALLIZATION ON POLIMIDE APERTURE PLATE FOR LASER-ABLATED NOZZLE --.

Signed and Sealed this
Fourth Day of March, 2014

Michelle K. Lee

Michelle K. Lee
*Deputy Director of the United States Patent and Trademark Office*